United States Patent [19]

Abel et al.

[11] 4,373,279

[45] Feb. 15, 1983

[54] FRAME STRAIGHTENING AND SUPPORTING DEVICE

[76] Inventors: Jack Abel, 16-24 202 St., Bayside, N.Y. 11360; Cora Abel, 12 Lee St., Cambridge, Mass. 02139

[21] Appl. No.: 184,521

[22] Filed: Sep. 5, 1980

[51] Int. Cl.[3] ..... G09F 1/12

[52] U.S. Cl. ..... 40/155; 40/10 R; 40/152.1; 248/488; 248/490

[58] Field of Search ..... 40/152.1, 152, 155, 40/10; 248/488, 490

[56] References Cited

U.S. PATENT DOCUMENTS

| | | | |
|---|---|---|---|
| 445,305 | 1/1891 | Tidball | 248/490 |
| 1,860,323 | 5/1932 | Ebeling | 40/152.1 |
| 2,661,560 | 12/1953 | Malby | 40/152.1 |
| 4,019,270 | 4/1977 | Trowbridge | 40/155 |
| 4,028,832 | 6/1977 | Wu | 248/490 |

*Primary Examiner*—Gene Mancene
*Assistant Examiner*—Wenceslao J. Contreras
*Attorney, Agent, or Firm*—Albert F. Kronman

[57] ABSTRACT

A framing device which includes a plurality of diametrically opposite adjustable arms to tension the frame by pressing against the inner surfaces of the corner joints.

1 Claim, 9 Drawing Figures

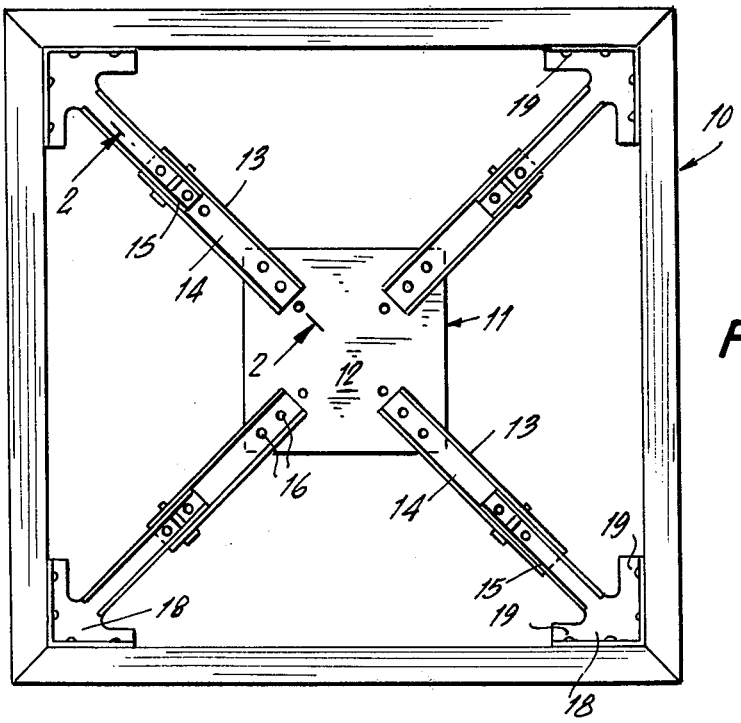
FIG. 1
FIG. 2
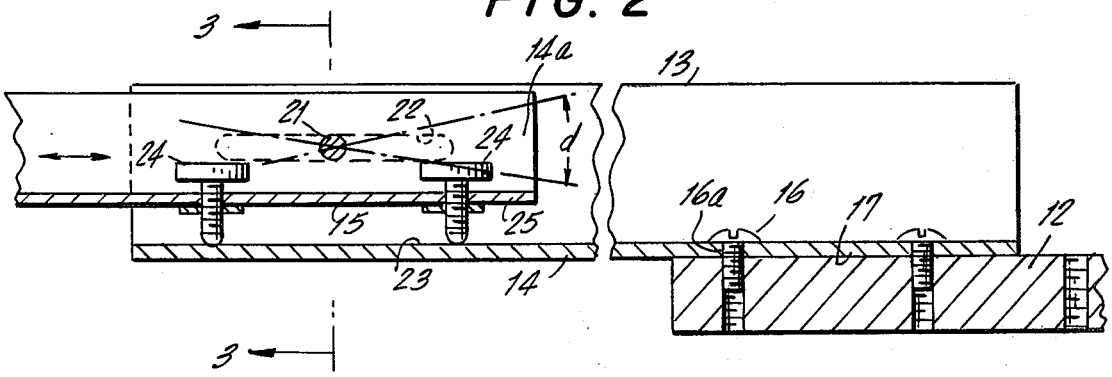
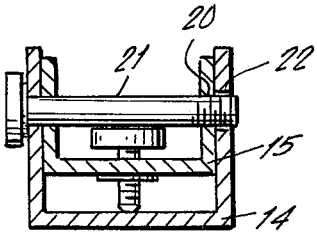
FIG. 3

FRAME STRAIGHTENING AND SUPPORTING DEVICE

BACKGROUND OF THE INVENTION

Conventional oil paintings done on canvas and a wide variety of graphic art displays are commonly mounted in or stretched over wooden frames. Although the wood is frequently dried and assembled so as to prevent the frame from warping, improper construction and neglect of frames often causes them to become distorted. Once a frame starts to warp, it is difficult to restore it to its proper shape. Where the frame distorts the original flat shape of an old canvas or other brittle backing, forcing the work back suddenly into its original shape will sometimes crack the paint or tear the surface of the display.

Accordingly, it is an object of the present invention to overcome the difficulties of conventional picture frames by providing a support to hold them and to prevent them from warping.

A further object of the present invention is to provide a way of straightening a frame over a period of time by applying slow, even pressure to its warped portion—thereby correcting the warp without damaging the artwork.

Still another object of the present invention is to provide a device for holding or straightening a circular, irregularly shaped or multisided frame.

Still another object of the invention is to provide a structure for supporting and straightening frames that may be adjusted to fit frames of different shapes and sizes.

SUMMARY OF THE INVENTION

A frrame straightening and support device made according to the present invention comprises a rigid central plate to which are connected a plurality of outwardly extending arms. These arms are fastened to the base and provided with telescoping portions ending in brackets to engage a wide variety of frame shapes or other structures to be straightened or supported. Adjusting screws and a fulcrum, may be used to adapt the support to non planner frames to reinforce them or to bring them back to a planar surface.

DESCRIPTION OF DRAWINGS

In the accompanying drawings forming a part hereof, similar parts have been given identical reference numbers, in which drawings:

FIG. 1 is a somewhat isometric view of one complete embodiment of the present invention attached to a rectangular frame.

FIG. 2 is a side view on an enlarged scale of a portion of one of the outwardly extending arms shown in FIG. 1.

FIG. 3 is a cross-sectional view taken along the line 3—3 in FIG. 2, looking in the direction of the arrows.

DESCRIPTION OF THE PREFERRED EMBODIMENTS

Figure 4:
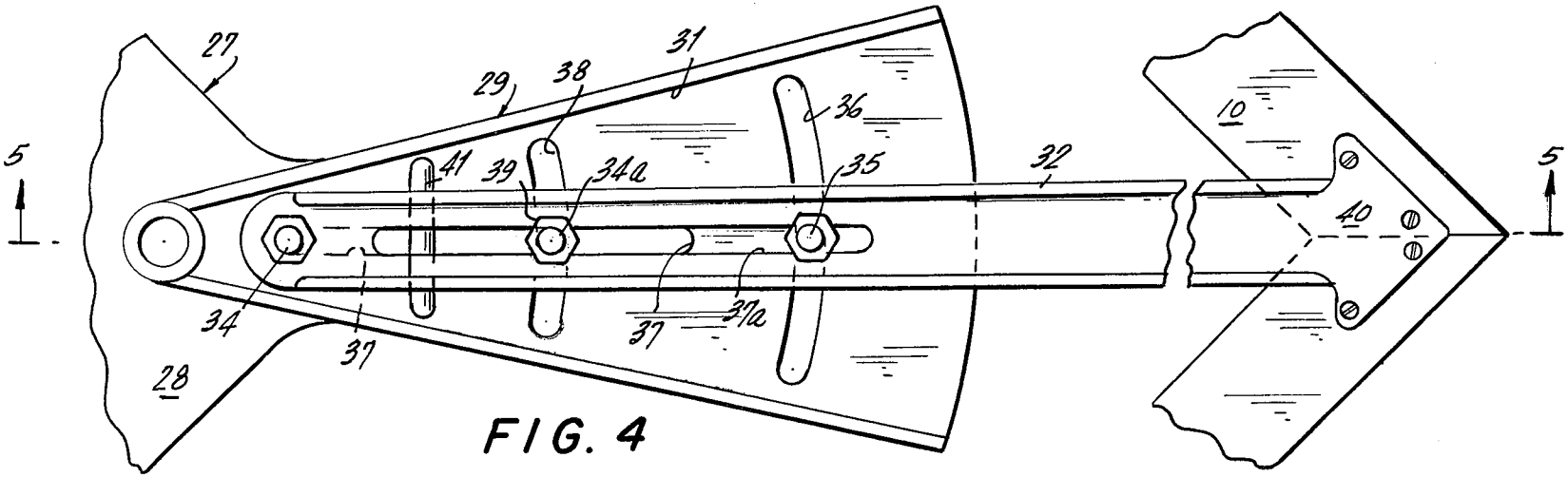
FIG. 4 is a fragmentary plan view of an outwardly extending arm assembly, another embodiment of the present invention.

Referring to the drawings and FIGS. 1—3 in particular, 10 indicates a conventional square or rectangular picture frame fitted with a frame straightening and supporting device 11 made in accordance with the present invention.

The frame straightening and supporting device 11 has a central plate 12 to which are attached four outwardly extending arms 13. The arms 13 consist of channel shaped inner segment 14 and channel shaped outer segment 15 slidably received within the inner segment. The inner segment 14 is attached at one end to the central plate 12 by means of screws 16. Screws 16 may be inserted through two spaced holes 16*a* in central plate 12 which are threaded for this purpose.

The outer ends of the arm segments 14 are provided with bracket shaped extensions 18. Extensions 18 are fastened to the adjacent portions of the frame by screws 19 or any other suitable means.

An elongated slot 20 is provided in each of the side walls 14*a* of the inner segments 14 of each arm 13 adjacent the outer end thereof as best shown in FIGS. 2 and 3.

The slot 20 is of a size to receive a pin 21 which is also thrust through openings 22 in the sidewalls of the outer segment 15 of each arm 13. The bottom surface 25 of the outer segment 15 is thus raised above the bottom inner surface 23 of inner segment 14 by reason of the position of the slots 20 and 22 and pin 21 so that the outer segment can be swung about the pin 21 with respect to the inner segment 14. Adjusting screws 24 located on either side of the pin 21 and extending through the bottom 25 of the outer segment 15 serve as angular positioning members for the outer segment and also lock the outer segment in place once it has been suitably adjusted. It will be apparent from an examination of FIG. 2 that by suitable tightening and loosening of the adjusting screws 24 the outer segment 15 can be swung with respect to the inner segment 14 and thereafter the screws firmly tightened against the bottom surface 23 of the adjacent portion of the inner segment to provide sufficient frictional contact to lock the outer segment in the desired position.

The operation of this embodiment of the invention will be apparent from the foregoing, and an examination of FIGS. 1-3. With the arms lengthened and adjusted so that they may be secured to the frame 10 in the manner shown in FIG. 1, the bracket shaped extensions are then secured to the frame by screws 19 or other fastening means. Thereafter, the arms 13 are angularly adjusted by means of screws 24 depending upon the condition of the frame. This adjustment can either maintain an unwarped frame in its planar condition or impart pressure on one or more portions of the frame to urge it into a planar configuration. In the case of badly warped frames such adjustment may be made over a period of time in order to avoid damaging stresses being built up within the frame.

Figure 5:
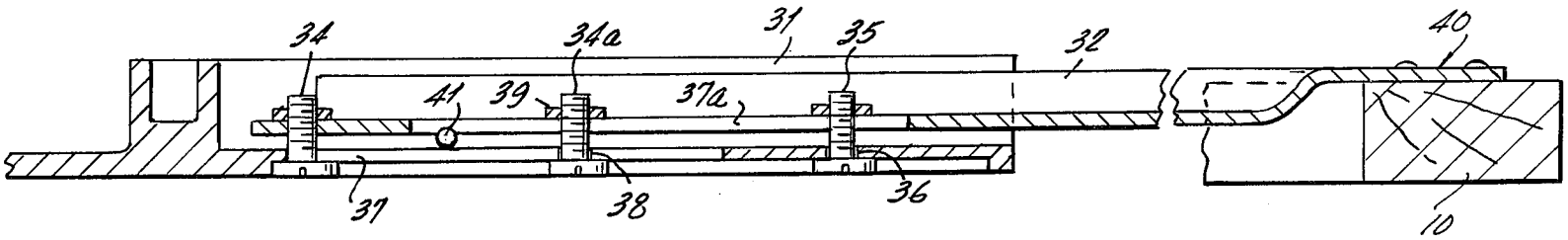
FIG. 5 is a longitudinal cross-sectional view taken along the line 5—5 in FIG. 4, looking in the direction of the arrows.
Figure 6:
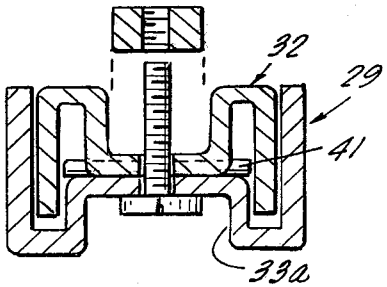
FIG. 6 is a cross-sectional view taken along line 6—6 of FIG. 4 looking in the direction of the arrows.

Referring to FIGS. 4-6 there is shown a second embodiment 27 of the present invention in which a central plate 28, made of some suitable rigid material is provided with inner arm segments 29 which are somewhat wedge shaped and may be either rigidly secured to the central plate 28 or pivotally secured. The inner arm segment 29 is provided with diverging upstanding sidewalls 31 between which there is received an outer segment 32.

The bottom 33*a* of the inner segment 29 may be flat as indicated in FIGS. 4 and 5 or recessed for greater strength as shown in FIG. 6. In both cases, the outer segment 32 is secured to the bottom of the inner segment by means of through bolts 34,34*a* which are slipped through an elongated slot 37 in the bottom 33. The fastening pin carried within an arcuate slot 36 in the bottom of the inner segment 29 extends upwardly through an elongated opening 37*a* in the outer segment 32. The fastening pin 35 is free to move along the arcuate slot 36 and the outer segment 32 is longitudinally moveable along the pin 35 by reason of the slot 37*a*. The pin 35 thus serves as a guide for the outer segment 32.

A second arcuate slot 38 is formed in the bottom of the inner arm segment 29 inwardly spaced from the first arcuate slot 36. The through bolt 34*a* extends through the elongated slots 37, 37*a* of the inner and arm segments 32 and rides within the second arcuate slot 38. The through bolt 34*a* thus also serves to guide and support the outer arm segment 32. Through bolt 34 serves as a pivot point for the inner end of the outer arm segment 32.

It will be seen from an examination of FIG. 4 that by loosening through bolt 34*a* as by turning nut 39, it is possible to swing the outer arm segment 32 through an arc limited by the upstanding sidewalls 31 of the inner arm segment 29. A short fulcrum 41 carried across the bottom of the inner arm segment serves as a bearing point against which the outer arm segment can be secured by tightening the through bolts 34,34*a*. In this manner the position of the bracket 40 at the end of the outer arm segment 32 can be adjusted to the desired location on the frame 10.

By sliding the outer arm segment 32 along the elongated opening 37, it is possible to adjust the frame straightener to the size of the frame.

Figure 8:
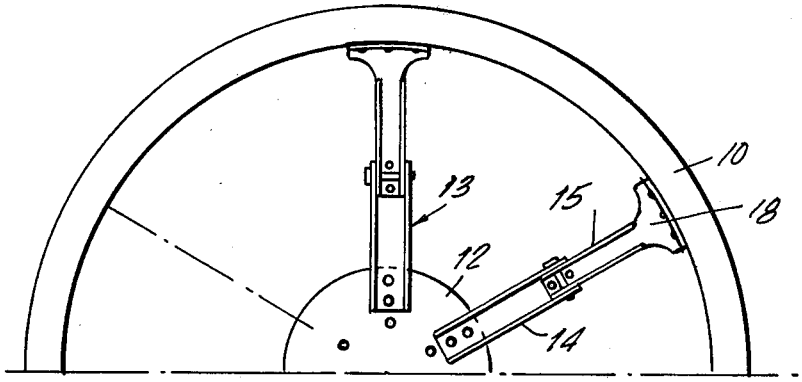
FIGS. 8 and 9 are plan views of further embodiments of the present invention useful for round frames.
Figure 7:
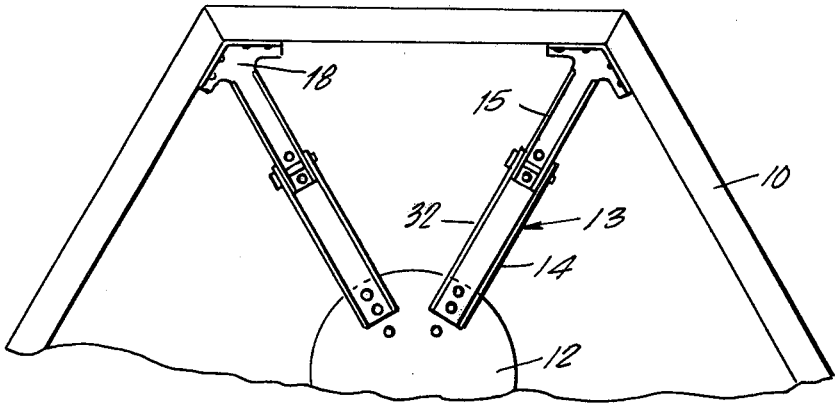
FIG. 7 is a plan view of another complete embodiment of the present invention useful for hexagonal frames.
Figure 9:
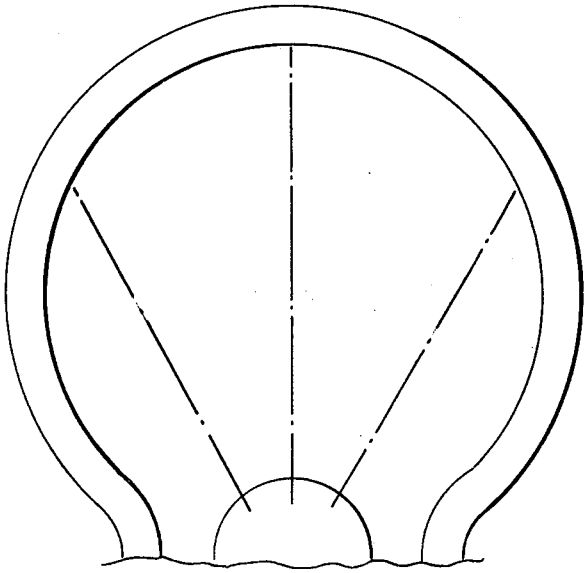

It will be apparent from the examination of FIGS. 1 and 8 that frame straighteners in accordance with the present invention may be used for hexagonal, octagonal, circular and other frame shapes without departing from the spirit of the invention.

Having thus fully described the invention, what is claimed as new and desired to be secured by Letters Patent of the United States, is:

1. A frame supporting and tightening device comprising a rigid central plate disposed parallel to the plane of the frame, a plurality of adjustable segmented arms of channel shaped cross-section secured at one end to the central plate and extending outwardly thereof, said segmented arms comprising an inner segment secured to the central plate and an outer segment slidably carried by the inner segments, means to adjustably secure the segments together, at least one bracket secured at the free end of each of the segmented arms and means to vary the position of the arm segments with respect to each other and the central plate to apply a desired force to portions of the frame.

* * * * *